US008448478B2

(12) United States Patent
Im et al.

(10) Patent No.: US 8,448,478 B2
(45) Date of Patent: May 28, 2013

(54) WASHING/DRYING MACHINE

(75) Inventors: Myong-Hun Im, Seoul (KR); Jin-Ho Chang, Seoul (KR); Kyung-Chul Woo, Seoul (KR); Kyeong-Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 959 days.

(21) Appl. No.: 12/448,013

(22) PCT Filed: Dec. 11, 2007

(86) PCT No.: PCT/KR2007/006430

§ 371 (c)(1),
(2), (4) Date: Jun. 4, 2009

(87) PCT Pub. No.: WO2008/072876

PCT Pub. Date: Jun. 19, 2008

(65) Prior Publication Data

US 2010/0101280 A1 Apr. 29, 2010

(30) Foreign Application Priority Data

Dec. 11, 2006 (KR) ..... 10-2006-0125874
Dec. 11, 2006 (KR) ..... 10-2006-0125875

(51) Int. Cl.
*D06F 39/00* (2006.01)
*D06F 58/00* (2006.01)
*D06F 58/20* (2006.01)

(52) U.S. Cl.
CPC ..... *D06F 39/008* (2013.01); *D06F 58/203* (2013.01)
USPC ..... 68/15; 68/20

(58) Field of Classification Search
CPC ..... D06F 25/00; D06F 39/00; D06F 39/003; D06F 35/00; D06F 58/203
USPC ..... 68/13 R, 15, 17 R, 20; 34/595, 597
See application file for complete search history.

(56) References Cited

U.S. PATENT DOCUMENTS

| | | | | |
|---|---|---|---|---|
| 2,873,539 | A | 2/1959 | Morey | |
| 5,072,526 | A * | 12/1991 | Hirota et al. | 34/60 |
| 5,305,484 | A | 4/1994 | Fitzpatrick et al. | |
| 6,898,951 | B2 * | 5/2005 | Severns et al. | 68/5 C |
| 7,222,438 | B2 * | 5/2007 | Jones | 34/60 |
| 7,610,693 | B2 * | 11/2009 | Burgess et al. | 34/597 |
| 2002/0050073 | A1 * | 5/2002 | Hagemann et al. | 34/595 |
| 2002/0100773 | A1 * | 8/2002 | Rodd et al. | 222/444 |
| 2004/0064970 | A1 * | 4/2004 | Hagemann et al. | 34/597 |
| 2004/0221476 | A1 * | 11/2004 | Jones et al. | 34/597 |
| 2005/0092035 | A1 * | 5/2005 | Shin et al. | 68/275 |
| 2005/0183208 | A1 * | 8/2005 | Scheper et al. | 8/142 |
| 2007/0151312 | A1 * | 7/2007 | Bruce et al. | 68/3 R |

FOREIGN PATENT DOCUMENTS

| | | |
|---|---|---|
| EP | 1 146 161 A1 | 10/2001 |
| GB | 2 231 944 A | 11/1990 |
| GB | 2 427 397 A | 12/2006 |

(Continued)

*Primary Examiner* — Joseph L Perrin
(74) *Attorney, Agent, or Firm* — McKenna Long & Aldridge LLP

(57) ABSTRACT

Disclosed is the washing/drying machine including a fragrance supplying means for supplying fragrance, and a heat supplying means for supplying heat to promote evaporation of a fragrance source stored in the fragrance supplying means. The washing/drying machine uses heat supplied by the heat supplying means so as to promote evaporation of a fragrance source in the fragrance supplying means, thereby increasing efficiency in fragrance supply.

4 Claims, 6 Drawing Sheets

FOREIGN PATENT DOCUMENTS

| | | | |
|---|---|---|---|
| JP | 08215488 | A | 8/1996 |
| JP | 08215489 | A | 8/1996 |
| JP | 10-75997 | | 3/1998 |
| JP | 2004350840 | A | 12/2004 |
| KR | 10-20020022478 | A | 3/2002 |
| KR | 10-20020062451 | A | 7/2002 |
| KR | 10-20060105325 | A | 10/2006 |
| WO | WO 2004/046448 | A1 | 6/2004 |

* cited by examiner

WASHING/DRYING MACHINE

This application is a 35 USC §371 national stage entry of International Application No. PCT/KR2007/006430, filed on Dec. 11, 2007, and claims priority to Korean Patent Application Numbers: 10-2006-0125874, filed Dec. 11, 2006, and 10-2006-0125875, filed Dec. 11, 2006, which are hereby incorporated by reference herein in its entirety.

TECHNICAL FIELD

The present invention relates to a washing/drying machine equipped with a fragrance supplying means and a heat supply means, and more particularly, to a washing/drying machine, which uses heat supplied by a heat supply means so as to promote evaporation of a fragrance source in a fragrance supplying means.

BACKGROUND ART

As an example of a washing machine having such a fragrance supplying means, Korean Utility Model Registration No. 20-0165264 discloses a washing machine in which a holder is integrally formed at a lower surface of a door so as to be disposed above a washing tub, a plurality of vent holes communicated with a receiving space are formed in the holder, and a perfume membrane for emitting fragrance is accommodated in the receiving space of the holder.

Meanwhile, the conventional washing machine is provided with the fragrance supplying means only, not with a heat supply means. Accordingly, it was substantially impossible for heat supplied by the heat supply means to be used to promote evaporation of a fragrance source in the fragrance supplying means. That is, there was no construction to forcibly promote the emission of the fragrance source by using heat. Thus, in the conventional washing machine, the supplying of fragrance depends only upon the natural emission of the fragrance source, thereby limiting the efficiency of the fragrance supplying.

In addition, when the fragrance source in the conventional washing machine is all consumed and thus needs to be replenished, a user would experience an inconvenience in replenishing it. That is, in Korean Utility Model Registration No. 20-0165264, the door needs to be opened to replace the perfume membrane, and then the perfume membrane should be inserted into the holder, causing trouble and inconvenience to the user.

DISCLOSURE OF THE INVENTION

Technical Problem

Therefore, it is an object of the present invention to provide a washing/drying machine which promotes evaporation of a fragrance source in a fragrance supplying means by using heat supplied by a heat supplying means.

It is another object of the present invention to provide a washing/drying machine which can promote evaporation of a fragrance source in a fragrance supplying means, by using steam heat from a steam supplying means, which is a heat supplying means.

It is another object of the present invention to provide a washing/drying machine having a fragrance supplying means, which enables easily replenishing a fragrance source.

TECHNICAL SOLUTION

To achieve these and other advantages and in accordance with the purpose of the present invention, as embodied and broadly described herein, there is provided a washing/drying machine, including: a fragrance supplying means for supplying fragrance, and a heat supplying means for supplying heat to promote evaporation of a fragrance source stored in the fragrance supplying means.

Preferably, the fragrance supplying means includes a cartridge for storing the fragrance source and having a fragrance emission hole for always emitting fragrance of the fragrance source stored, and a cartridge dock at which the cartridge is mounted.

Preferably, the fragrance supplying means includes a cartridge for storing the fragrance source and having a fragrance emission hole for emitting fragrance of the fragrance source stored, a cartridge dock at which the cartridge is mounted, and an opening/closing means for selectively opening/closing the fragrance emission hole.

Preferably, the opening/closing means is a plate spring for opening the fragrance emission hole when the cartage is mounted at the cartridge dock, and the plate spring includes a curved portion having one end thereof fixed to the cartridge and another end thereof free, an end portion disposed at an end of the curved portion and contacting a protrusion formed in the cartridge dock, and a stopper protruding from the curved portion and for opening the fragrance emission hole when the end portion contacts the protrusion.

Preferably, the opening/closing means is of a bimetallic or shape memory alloy for opening the fragrance emission hole when heat is supplied by the heat supplying means.

Meanwhile, the above-mentioned washing/drying machine further includes a fragrance supply pipe for supplying fragrance to the inside of the tub or drum, and it is preferable that the heat supplying means is a heater.

Or, the washing/drying machine further includes a fragrance supply pipe for supplying fragrance to the inside of the tub or drum, and it is preferable that the heat supplying means is a steam pipe.

Or, preferably, the heat supplying means of the washing/drying machine is a hot blast duct.

To achieve these and other advantages and in accordance with the purpose of the present invention, as embodied and broadly described herein, there is provided a washing/drying machine, including: a fragrance supplying means for supplying fragrance, and a heat supplying means for supplying steam directly to the fragrance supplying means so as to promote evaporation of a fragrance source stored in the fragrance supplying means.

Preferably, the fragrance supplying means includes a cartridge for storing the fragrance source and having a fragrance emission hole for always emitting fragrance of the fragrance source stored, and a cartridge dock at which the cartridge is mounted.

Preferably, the fragrance supplying means includes a cartridge for storing the fragrance source and having a fragrance emission hole for emitting fragrance of the fragrance source stored, a cartridge dock at which the cartridge is mounted, and an opening/closing means for selectively opening/closing the fragrance emission hole.

Here, preferably, the opening/closing means includes a piston contacting the cartridge dock by partially protruding from an outside of the cartridge and for opening/closing the fragrance emission hole, and an elastic member for elastically biasing the piston.

Or, preferably, the opening/closing means includes a horizontal wall for dividing the inside of the cartridge into a first chamber and a second chamber, a piston partially protruding from the outside of the cartridge so as to contact the cartridge dock, and for opening/closing the fragrance emission hole formed in the first chamber, and an elastic member for elastically biasing the piston.

Here, it is preferable that the opening/closing means is further provided with an inner button for moving the piston.

Preferably, the washing/drying machine is further provided with an external button for mounting or dismounting the cartridge to or from the cartridge dock.

Meanwhile, it is preferable that the heat supplying means includes a steam pipe for passing through a portion of steam to the fragrance supplying means, or a steam pipe for passing through all steam.

To achieve these and other advantages and in accordance with the purpose of the present invention, as embodied and broadly described herein, there is provided a washing/drying machine, including: a casing, a tub received inside the casing, a drum received inside the tub, a driving motor for driving the drum, a fragrance supplying means having a cartridge for storing a fragrance source and a cartridge dock for mounting the cartridge so as to supply fragrance to the inside of the tub or drum, and a heat supplying means for directly supplying steam so as to promote evaporation of the fragrance source stored in the cartridge.

Preferably, a fragrance emission hole is formed in the cartridge so as to always emit fragrance of the fragrance source stored.

A fragrance emission hole is formed in the cartridge so as to emit fragrance of the fragrance source stored, and preferably, an opening/closing means is further provided to selectively opening/closing the fragrance emission hole.

Meanwhile, it is preferable that the heat supplying means includes a main pipe for supplying steam to the inside of the tub or drum, a first diverged pipe diverged from the main pipe and connected to one side of the cartridge dock, and a second diverged pipe connected to another end of the cartridge dock and the main pipe.

Or, preferably, the heat supplying means includes a first pipe for supplying steam to the cartridge dock, and a second pipe connected to the cartridge dock and for supplying steam to the tub or drum.

Or, preferably, the heat supplying means includes a main pipe for supplying steam to the inside of the tub or drum, and a connection pipe for connecting the cartridge dock and the main pipe.

ADVANTAGEOUS EFFECTS

The washing/drying machine according to the present invention has the following advantages.

First, there are provided a heat supplying means and a fragrance supplying means, thereby promoting evaporation of the fragrance source in the fragrance supplying means by using heat supplied by the heat supplying means, thus to provide the washing/drying machine having the fragrance supplying means with fragrance supplying of enhanced efficiency.

Second, when the fragrance source is consumed and there is a need to replenish the fragrance source, a user can easily replenish the fragrance source.

Third, the amount of fragrance supplied can be controlled by properly adjusting the temperature of the heat supplied by the heat supplying means, thereby providing convenience.

Fourth, when a portion of or all steam is directly supplied to the heat supplying means, the fragrance source can be actively evaporated. Also, the fragrance mixed with steam can be securely supplied to the tub or drum without being emitted to other places.

Fifth, the user can select a certain period of time necessary to supply fragrance, so that fragrance can be supplied only during the selected period of time. Thus, the consumption of the fragrance source can be reduced, and a replenishment cycle becomes longer, thereby reducing the cost.

The washing/drying machine having the fragrance supplying means according to the present invention can be variously used for a household, industry, factory, and the like.

BRIEF DESCRIPTION OF THE DRAWINGS

The above and other objects, features, and advantages of the present invention will be made apparent from the following description of the preferred embodiments, given as non-limiting examples, with reference to the accompanying drawings in which.

MODES FOR CARRYING OUT THE INVENTION

Figure 1:
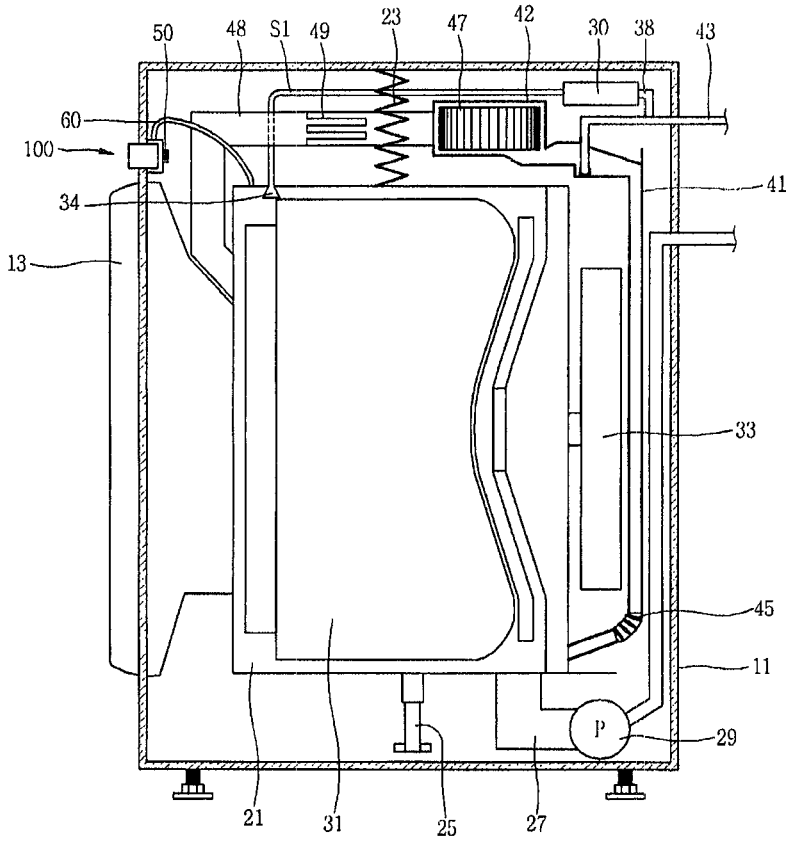
FIG. 1 is a side cross-sectional view illustrating a washing/drying machine having a heat supplying means and a fragrance supplying means according to a first embodiment of the present invention.
Figure 2:
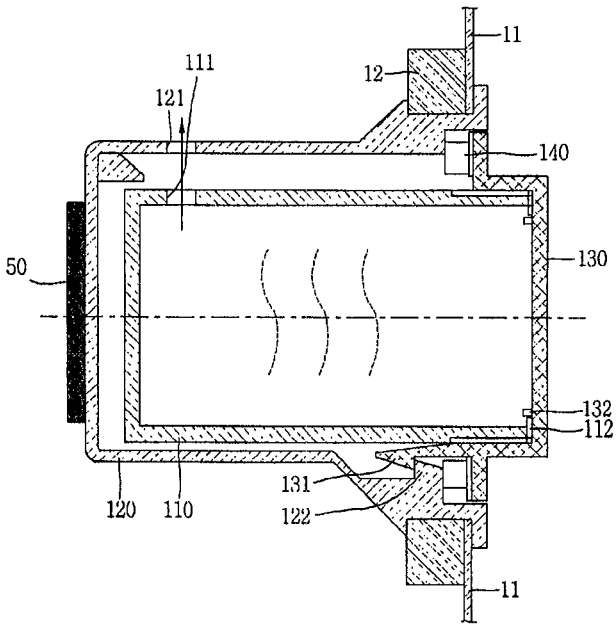
FIG. 2 is a diagram illustrating a heater serving as the heat supplying means, and the fragrance supplying means in FIG. 1.

Description will now be given in detail of the washing/drying machine according to the present invention, examples of which are illustrated in the accompanying drawings. FIG. 1 is a side cross-sectional view illustrating a washing/drying machine having a heat supplying means and a fragrance supplying means according to a first embodiment of the present invention. FIG. 2 is a diagram illustrating a heater serving as the heat supplying means, and the fragrance supplying means in FIG. 1. Here, solid line arrows indicate the flow of fragrance, and dashed line arrows indicate the evaporation of fragrance.

Referring to FIG. 1, the washing/drying machine according to one embodiment of the present invention includes a casing 11 having a receiving space therein, a tub 21 disposed inside the casing 11 and for receiving washing water therein, a drum 31 disposed inside the tub 21 so as to be rotatable centering around a rotation shaft disposed almost in a horizontal direction, a driving motor 33 for driving the drum 31, a hot blast duct 48 for introducing hot air into the inside of the tub 21, a steam supplying means 30 for supplying steam to laundry received in the drum 31, a fragrance supplying means 100 for supplying fragrance to the inside of the tub 21 or the drum 31 through a fragrance supply pipe 60, and a heat supplying means 50 for supplying heat so as to promote the evaporation of a fragrance source stored in the fragrance supplying means 100.

The casing 11 forms an outer aspect of the washing/drying machine. An entrance opening, through which the laundry is introduced into or removed, is formed in a front surface of the casing 11, and a door 13 for opening/closing the entrance opening is provided at one side of the entrance opening.

The tub 21 has a tubular form having one open end, and the opened area thereof is disposed at a position corresponding to the entrance opening. A spring member 23 and a damper 25 are respectively mounted at upper and lower sides of the tub 21 so as to dampingly-support the tub 21. And, a drainpipe 27 and a drain pump 29 are provided at a lower side of the tub 21 so as to drain washing water.

At a rear of the tub 21 installed is a condensation pipe 41 having one end thereof communicated with the tub 21, and another end thereof extended upwardly. A blowing fan 47 is disposed at the upper end of the condensation pipe 41 so as to discharge air from inside the tub 21 through the condensation pipe 41.

One end of the hot blast duct 48 having another end thereof communicated to an upper front surface of the tub 21 is coupled to a discharge side of the blowing fan 47, and a heater 49 is mounted inside the hot blast duct 48 so as to heat air.

Meanwhile, the condensation pipe 41 has an "L" shape to enable air and condensate water discharged from the tub 21 to flow therein, and a fan coupling portion 42 is formed at an upper portion of the condensation pipe 41 so as to be coupled to the blowing fan 47. One end of a connection bellows 45 having another end thereof communicated with the tub 21 is connected to be communicated to a lower end of the condensation pipe 41.

With this construction, if a dehydrating process has been completed and a drying process is started, and thereby the blowing fan 47 is driven, air is discharged from inside the tub 21 and flows upwardly along the condensation pipe 41. The air flowing upwardly flows along the hot blast duct 48, and is heated by the heater 49 thus to be introduced into the inside of the tub 21.

The high temperature air having been introduced into the tub 21 absorbs moisture from the laundry and flows along the condensation pipe 41, and then is cooled by condensate water supplied from the condensate water supply pipe 43 for condensation whereby the moisture from the laundry contained therein, is condensed in the condensation pipe 41. The low temperature dry air from which the moisture has been removed, is heated by the heater 49, and the high temperature dry air having been heated, is introduced back into the tub 21, thereby performing the process of drying the laundry.

The steam supplying means 30 includes a heater (not shown) disposed inside the steam supplying means 30 for heating water stored therein, a water is supply line 38 for receiving water from the condensate water supply pipe 43, a steam pipe S1 for supplying steam to the tub 21 or drum 31, and an opening/closing valve (not shown) disposed in the water supply line 38 so as to block or flow water supplied to the water supply line 38. The steam generated by the steam supplying means 30 is sprayed onto the laundry received in the drum 31 via the steam pipe S1.

Referring to FIGS. 1 and 2, the fragrance supplying means 100 is penetratingly mounted at the front surface of the casing 11 above the door 13. Since the fragrance supplying means 100 can be detachably mounted at the front surface of the casing 11 from the outside, a user may conveniently detach the fragrance supplying means 100 from the casing 11 to replenish the fragrance source, and then easily mount it back into the casing 11.

The fragrance supplying means 100 includes a cartridge 110 having a fragrance emission hole 111 for storing the fragrance source and constantly emitting the stored fragrance, a cartridge dock 120 into which the cartridge 110 is mounted, a cartridge cap 130 coupled to an outer end of the cartridge 110 and being inserted into the cartridge dock 120, and a dock seal 140 for sealing between the cartridge dock 120 and the cartridge cap 130 to prevent the emission of fragrance to the outside of the washing/drying machine.

The fragrance source is stored inside the cartridge 110. Such fragrance source may have an aromatic fragrance or a perfume membrane. To be certain, fragrance sources having other fragrance can be used according to the user's preference.

The upper surface of the cartridge 110 is opened, and a female threaded portion 112 is formed on an inner circumferential surface of the cartridge 110 such that the cartridge cap 130 can be coupled to the outer end of the cartridge 110. A male threaded protrusion 132, in correspondence to the female threaded portion 112, is formed at the cartridge cap 130 to be coupled to the female threaded portion 112. With the above-described construction, after the cartridge cap 130 is turned in a direction so as to be unthreaded for separation from the cartridge 110, the fragrance source is replenished in the cartridge 110. After the fragrance source is replenished, the cartridge cap 130 is threaded onto the cartridge 110 in a coupling thread direction.

The cartridge dock 120 is penetratingly installed in the front surface of the casing 11. For this, a connection member 12 is installed for coupling the casing 11 and the cartridge dock 120. One side of the connection member 12 is bonded or welded to an inner surface of the casing 11, and another side of the connection member 12 is bonded or welded to an outer circumferential surface of the cartridge dock 120. Another fragrance emission hole 121 is formed at the cartridge dock 120 so as to spread fragrance emitted from the fragrance emission hole 111 of the cartridge 110 to the inside of the washing/drying machine. The fragrance supply pipe 60 is connected to the fragrance emission hole 121, and the fragrance emitted from the fragrance emission hole 121 via the fragrance supply pipe 60 (referring to FIG. 1) is introduced into the tub 21 or drum 31.

A stopping protrusion 122 is disposed at an outer end of the cartridge dock 120 for hook-coupling of the cartridge cap 130. A hook 131 stopped by the stopping protrusion 122 is formed at the cartridge cap 130 in correspondence to the stopping protrusion 122.

With the above-described construction, if the cartridge 110 is pushed into the cartridge dock 120, the hook 131 of the cartridge cap 130 is coupled to the stopping protrusion 122 of the cartridge dock 120. Accordingly, the cartridge 110 is mounted to the cartridge dock 120.

The heater 50, which is a heat supplying means, is installed on an inner end surface of the cartridge dock 120. The heater 50 serves to supply heat for promoting evaporation of the fragrance source in the cartridge 110.

With such a construction, when the heater 50 is turned off, heat is not supplied to the fragrance source received in the cartridge 110. Accordingly, although the fragrance emission holes 111, 121 are opened, evaporation of the fragrance source is not promoted, thereby causing little fragrance emission. Meanwhile, when the heater 50 is turned on, heat is transferred to the cartridge 110 through the end surface of the cartridge dock 120. The thusly transferred heat serves to promote the evaporation of the fragrance source that is received in the cartridge 110. Accordingly, fragrance is greatly emitted through the fragrance emission holes 111, 121. Thus, fragrance may not only be emitted autonomously, but also be forcibly emitted by heating, thereby enhancing the efficiency of the fragrance supplying and providing convenience by properly adjusting the amount of fragrance supplied.

Figure 3:
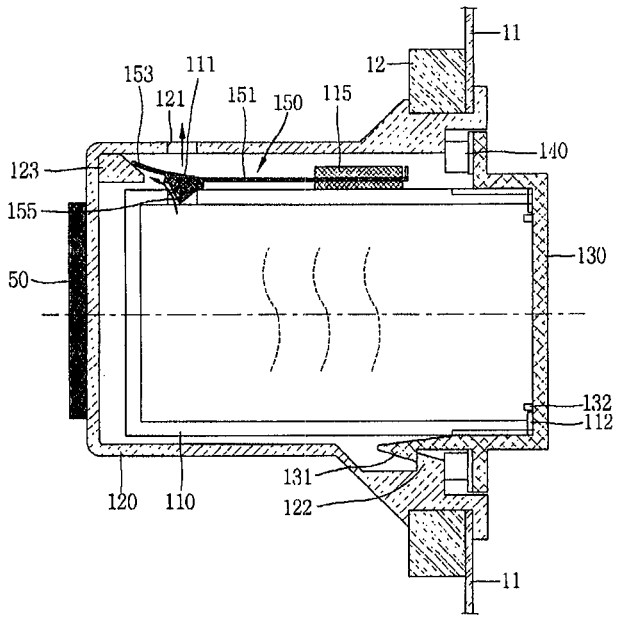
FIG. 3 is a diagram illustrating a heater serving as a heat supplying means, and a fragrance supplying means having a plate spring for selectively opening/closing a fragrance emission hole according to a first modification example of the present invention.

FIG. 3 is a diagram illustrating a heater serving as a heat supplying means, and a fragrance supplying means having a plate spring for selectively opening/closing a fragrance emission hole according to a first modification example of the present invention. Here, solid line arrows indicate the flow of fragrance, and dashed line arrows indicate the evaporation of fragrance. For reference, the same reference numerals will be given to the same components having the same functions, and detailed explanations therefor are omitted.

Referring to FIG. 3, the fragrance supplying means 100 includes a cartridge 110 for storing a fragrance source and having a fragrance emission hole 111 for emitting the stored fragrance, a cartridge dock 120 into which the cartridge 110 is mounted, a cartridge cap 130 coupled to an outer end of the cartridge 110 and being inserted into the cartridge dock 120, a dock seal 140 for sealing between the cartridge dock 120 and the cartridge cap 130 to prevent the emission of fragrance to the outside of the washing/drying machine, and an opening/closing means 150 for selectively opening/closing the fragrance emission hole 111.

Since description of the other components has already been given, description of only the opening/closing means 150 will be given. The opening/closing means 150 is implemented as a plate spring for opening the fragrance emission hole 111 only when the cartridge 110 is mounted in the cartridge dock 120.

The plate spring may include a curved portion 151 having one end thereof fixed by being inserted into a support block 115 of the cartridge 110 and another end thereof free, an end portion 153 disposed at an end of the curved portion 151 and contacting a protrusion 123 formed in the cartridge dock 120, and a stopper 155 protruding from the curved portion 151 and opening the fragrance emission hole 111 when the end portion 153 contacts the protrusion 123. Based on such a construction, when the cartridge 110 is mounted in the cartridge dock 120, while the end portion 153 contacts the protrusion 123, the curved portion 151 is curved upwardly. Thus, the fragrance emission hole 111, which is closed by the stopper 155, becomes opened.

When the heater 50 is turned off, heat is not supplied to the fragrance source received in the cartridge 110. Accordingly, although the fragrance emission holes 111, 121 are opened, the evaporation of the fragrance source is not promoted, thereby causing little fragrance emission. Meanwhile, when the heater 50 is turned on, heat is transferred to the cartridge 110 through the end surface of the cartridge dock 120. The thusly transferred heat serves to promote the evaporation of the fragrance source that is received in the cartridge 110. Accordingly, fragrance is greatly emitted through the fragrance emission holes 111, 121. Thus, fragrance may not only be emitted autonomously, but also be forcibly emitted by heating, thereby enhancing the efficiency of the fragrance supplying. Further, the amount of fragrance supplied can be controlled by properly adjusting the temperature of the heater 50, thereby providing convenience.

Figure 4:
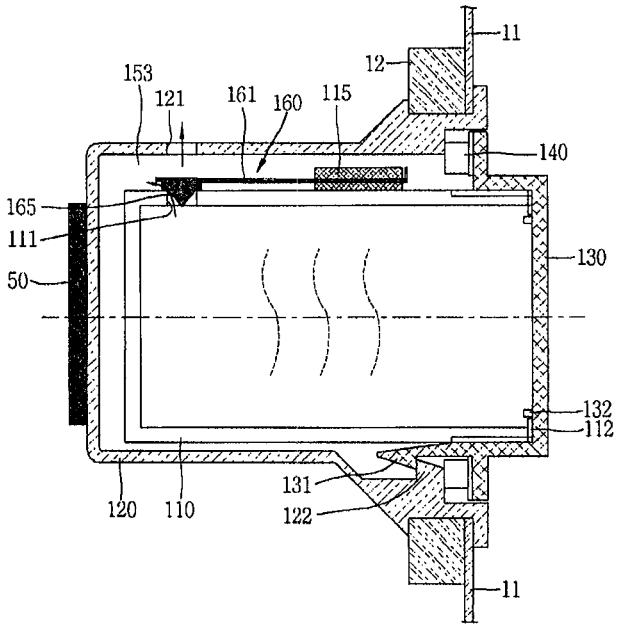
FIG. 4 is a view illustrating a heater serving as a heat supplying means, and a fragrance supplying means having a bimetallic or shape memory alloy for selectively opening/closing the fragrance emission hole according to a second modification example of the present invention.

FIG. 4 is a view illustrating a heater serving as the heat supplying means, and a fragrance supplying means having a bimetallic or shape memory alloy for selectively opening/closing the fragrance emission hole according to a second modification example of the present invention. Here, solid line arrows indicate the flow of fragrance, and dashed line arrows indicate the evaporation of fragrance. For reference, the same reference numerals will be given to the same components having the same functions, and detailed explanations therefor are omitted.

Referring to FIG. 4, the fragrance supplying means 100 includes a cartridge 110 for storing a fragrance source and having a fragrance emission hole 111 for emitting the stored fragrance, a cartridge dock 120 into which the cartridge 110 is mounted, a cartridge cap 130 coupled to an outer end of the cartridge 110 and being inserted into the cartridge dock 120, a dock seal 140 for sealing between the cartridge dock 120 and the cartridge cap 130 to prevent the emission of the fragrance to the outside of the washing/drying machine, and an opening/closing means 150 for selectively opening/closing the fragrance emission hole 111.

Since description of the other components has already been given, the description of only the opening/closing means 150 will be given. The opening/closing means 150 is implemented as a bimetallic or shape memory alloy, which opens the fragrance emission hole 111 when the cartridge 110 is mounted at the cartridge dock 120.

The bimetal or shape memory alloy includes a curved portion 161 having one end thereof fixed by being inserted into a support block 115 of the cartridge 110 and another end thereof free, and a stopper 165 protruding from the curved portion 161 and for opening the fragrance emission hole 111 while being upwardly curved when heat is applied by the heater 50.

When the heater 50 is turned off, heat is not supplied to the fragrance source received in the cartridge 110. Accordingly, the evaporation of the fragrance source is not promoted, thereby not opening the fragrance emission hole 111. Meanwhile, when the heater 50 is turned on, heat is transferred to the cartridge 110 through the end surface of the cartridge dock 120. The thusly transferred heat promotes the evaporation of the fragrance source received in the cartridge 110. Also, as soon as the curved portion 161 is curved upwardly, the stopper 165 opens the fragrance emission hole 111. Accordingly, fragrance is greatly emitted through the fragrance emission holes 111, 121. Thus, fragrance may not only be emitted autonomously, but also be forcibly emitted by heating, thereby enhancing the efficiency of the fragrance supplying. Further, the amount of fragrance supplied can be controlled by properly adjusting the temperature of the heater 50, thereby providing convenience.

Figure 5:
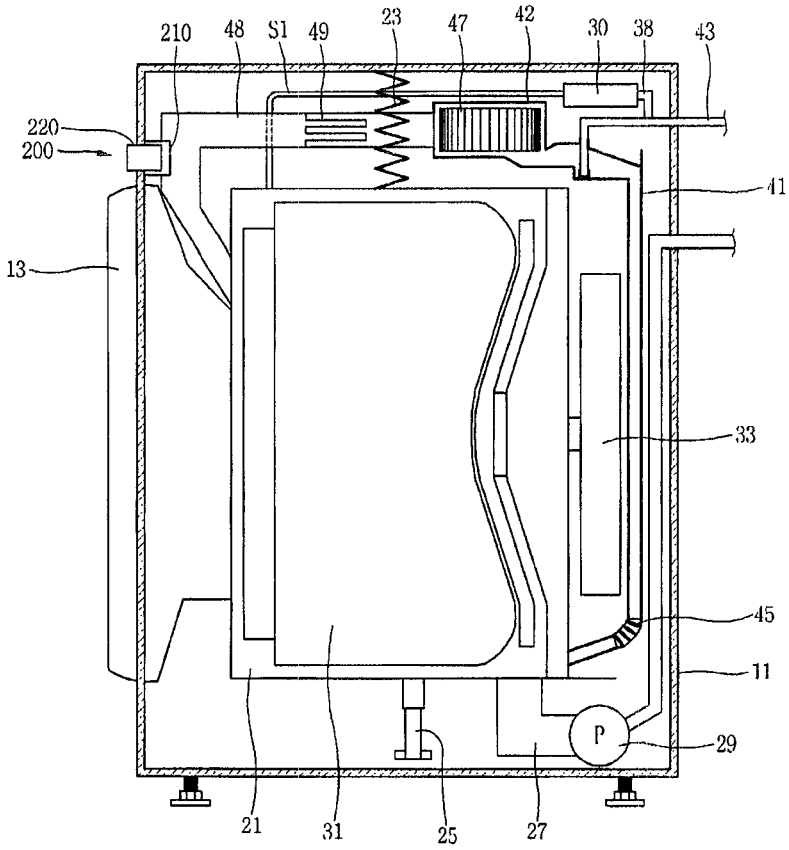
FIG. 5 is a view illustrating a hot blast duct serving as a heat supplying means, and a fragrance supplying means according to a third modification example of the present invention.

FIG. 5 is a view illustrating a hot blast duct serving as a heat supplying means, and a fragrance supplying means according to a third modification example of the present invention. Referring to FIG. 5, hot air passes through a hot blast duct 48, serving as the heat supplying means. For this, the fragrance supplying means 200 includes a cartridge dock 210 installed at the hot blast duct 48, and a cartridge 220 for receiving the fragrance source and detachably coupled to the cartridge dock 210. The detailed construction and operation of the fragrance supplying means 200 may be the same as that described for FIGS. 2 through 4, and detailed explanations therefor are omitted. Here, since the fragrance supplying means 200 is installed at the hot blast duct 48 connected to the tub 21, fragrance emitted from the fragrance emission hole 121 (referring to FIG. 2) is mixed with hot air, and is then supplied to the tub 21 or drum 31, thereby not requiring a separate fragrance supply pipe 60 (referring to FIG. 1).

Figure 6:
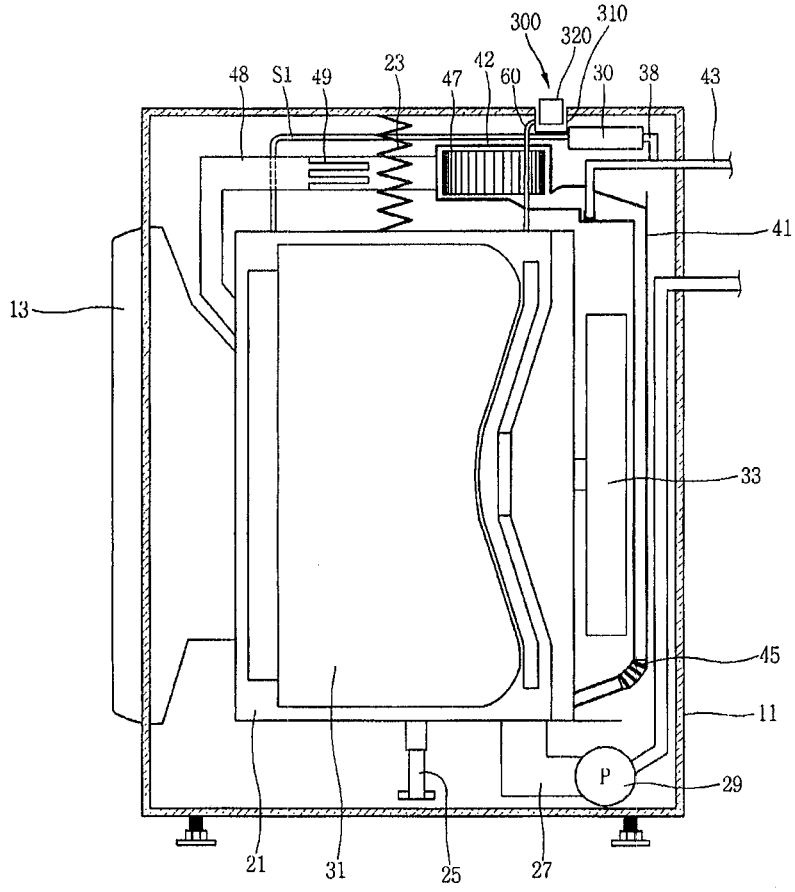
FIG. 6 is a view illustrating a steam pipe serving as a heat supplying means, and the fragrance supplying means according to a fourth modification example of the present invention.

FIG. 6 is a view illustrating a steam pipe serving as a heat supplying means, and a fragrance supplying means according to a fourth modification example of the present invention. Referring to FIG. 6, steam heat passes through a steam pipe S1, serving as a heat supplying means. For this, a fragrance supplying means 300 includes a cartridge dock 310 penetratingly installed at an upper side of the casing 11 so as to be adjacent to the steam pipe S1, and a cartridge 320 for receiving a fragrance source and detachably coupled to the cartridge dock 310. The detailed construction and operation of the fragrance supplying means 300 may be the same as that described for FIGS. 2 through 4, and detailed explanations therefor are omitted.

Figure 7:
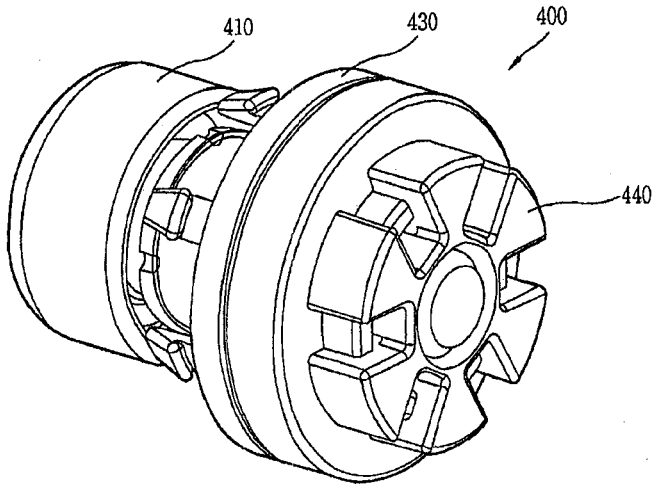
FIG. 7 is a view illustrating a fragrance supplying means according to a fifth modification example of the present invention.
Figure 8:
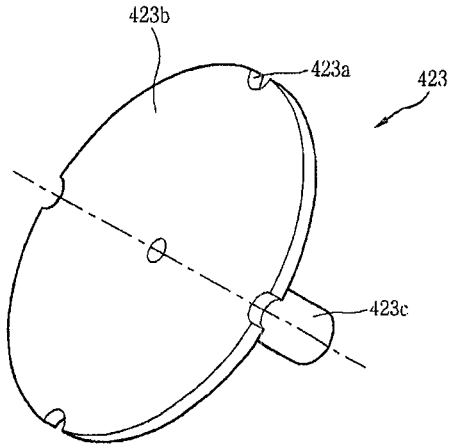
FIG. 8 is a perspective view showing a horizontal wall in FIG. 7.
Figure 9:
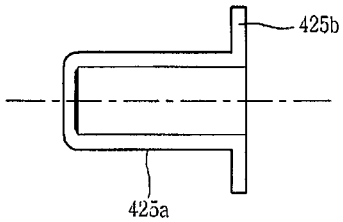
FIG. 9 is a perspective view showing a piston in FIG. 7.
Figure 10:
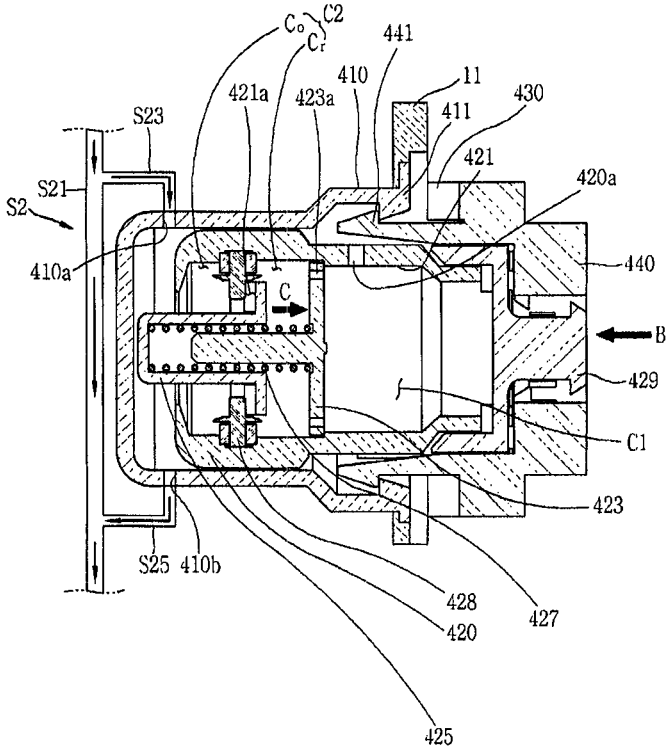
FIG. 10 is a diagram showing that a steam pipe of a steam supplying means is partially bypassed to the fragrance supplying means in FIG. 7.

FIG. 7 is a view illustrating a fragrance supplying means according to a fifth modification example of the present invention. FIG. 8 is a perspective view showing a horizontal wall in FIG. 7. FIG. 9 is a perspective view showing a piston in FIG. 7. And, FIG. 10 is a diagram showing that a steam pipe of a steam supplying means is partially bypassed to the fragrance supplying means in FIG. 7.

Referring to FIGS. 7 through 10, the fragrance supplying means 400 according to the fifth modification example of the present invention includes a cartridge dock 410, a cartridge 420 for receiving a fragrance source therein and detachably coupled to the cartridge dock 410, a cartridge seal 430 installed between the cartridge dock 410 and the cartridge 420, and an external button 440 for mounting or dismounting the cartridge 420 to or from the cartridge dock 410.

Through-holes 410*a* and 410*b* are disposed at the cartridge dock 410 so as to discharge fragrance of the fragrance source emitted from the mounted cartridge 420 to the tub 21 or drum 31.

The cartridge 420 includes a receiving chamber 421, a discharge hole 421*a* disposed at one end of the receiving chamber 421 for emitting fragrance, and an opening/closing means for opening/closing the discharge hole 421*a*.

The opening/closing means includes a horizontal wall 423 installed inside the cartridge 420 for dividing the receiving chamber 421 into a first chamber C1 and a second chamber C2, a piston 425 partially protruding from the outside of the cartridge 420 so as to contact the cartridge dock 410, and for opening/closing the discharge hole 421*a*, an elastic member 427 for elastically biasing the piston 425, a sealing member 428 for opening/closing the discharge hole 421*a* disposed between the cartridge 420 and the piston 425, and an inner button 429 for moving the piston 425.

Referring to FIGS. 8 through 10, the horizontal wall 423 includes a plate 423*b* for dividing the inside of the cartridge 420 into the first chamber C1 and the second chamber C2, a guide protrusion 423*c* protruding from a central portion of the plate 423*b* with a certain length, and fragrance holes 423*a* penetratingly formed in an outer circumferential surface of the plate 423*b*.

The fragrance source is received in the first chamber C1, and fragrance of the fragrance source received in the first chamber C1 is moved to the second chamber C2 through the fragrance holes 423*a*.

Further, a fragrance emission hole 420*a* is formed in the first chamber C1 such that fragrance of the fragrance source received in the cartridge 420 can always be discharged to the cartridge dock 410. Accordingly, fragrance can be supplied only when the user demands, or can be continuously supplied in a fixed amount as usual.

Referring to FIGS. 9 and 10, the piston 425 includes a contact portion 425*a* contacting the end of the cartridge dock 410, and a partition wall 425*b* disposed on an outer circumferential surface of the contact portion 425*a* so as to divide the second chamber C2 into a replenishment chamber Cr and an outside chamber Co. By installing a sponge (not shown) inside the replenishment chamber Cr, the amount and speed at which the fragrance source is emitted can be adjusted, thereby stably emitting fragrance.

The elastic member 427 is a spring which is installed inside the contact portion 425*a* such that the guide protrusion 423*c* can be penetrated thereinto. If force applied to the cartridge 420 is removed by the elastic member 427, the cartridge 420 is returned to its original position.

The inner button 429 is a button which is installed outside the cartridge 420, and is pressed by the user so that the guide protrusion 423*c* can be slid inside the contact portion 425*a* by making the cartridge 420 to perform a relative motion with respect to the cartridge dock 410.

The sealing member 428 is installed at an inner surface of the cartridge 420, and when the guide protrusion 423*c* is slid inside the contact portion 425*a*, the discharge hole 421*a* is formed between the sealing member 428 and the partition wall 425*b*. Through the discharge hole 421*a*, the replenishment chamber Cr and the outside chamber Co are selectively communicated.

The cartridge seal 430 serves to adhere the external button 440 closely to the outer circumferential surface of the cartridge dock 410, and to prevent the emission of fragrance to the outside.

The external button 440 is installed to cover the outer circumferential surface of the inner button 429, and mounts or dismounts the cartridge 420 to the cartridge dock 410.

Meanwhile, in order to supply a portion of steam from the steam supplying means 30 to the fragrance supplying means 400, a steam pipe S2 of the steam supplying means 30 includes a main pipe S21 for supplying steam to the inside of the tub 21 or drum 31, a first diverged pipe S23 diverged from the main pipe S21 and connected to one side of the cartridge dock 410, and a second diverged pipe S25 connected to another side of the cartridge dock 410 and to the main pipe S21. In more detail, the main pipe S21 is connected to a spray nozzle 34 (referring to FIG. 1) so as to supply steam to the tub 21 or drum 31.

The first diverged pipe S23 serves to connect the main pipe S21 and the through-hole 410*a* formed in the circumference of the cartridge dock 410.

The second diverged pipe S25 serves to connect the main pipe S21 and another through-hole 410*b* formed in the circumference of the cartridge dock 410.

With such a detailed construction, a portion of the steam flowing in the main pipe S21 is supplied into the cartridge dock 410 through the first diverged pipe S23, is mixed with fragrance, and then through the second diverged pipe S25 flows together with steam flowing in the main pipe S21. Since the steam directly flows in the cartridge dock 410, the steam heat can be directly transferred to the fragrance source received in the cartridge 420. Accordingly, the evaporation of the fragrance source can be actively promoted, and fragrance mixed with steam can be securely supplied to the tub 21 or drum 31, without being emitted to other places.

Hereinafter, description of the method of supplying fragrance of the fragrance supplying means and the method for replenishing the fragrance source will be given in detail.

Referring to FIGS. 9 and 10, if the user presses the inner button 429 in the direction of the arrow B, the elastic member 427 is compressed in the direction of the arrow C. Then, the cartridge 420, the sealing member 428 and the horizontal wall 423 are integrally moved until the cartridge 420 is stopped by the end of the cartridge dock 410.

Here, in a state that the contact portion 425*a* of the piston 425 is not moved by being stopped by the end of the cartridge dock 410, the sealing member 428 is separated from the horizontal wall 423, thereby forming the emission hole 421*a* therebetweeen. Through the emission hole 421*a*, fragrance of the fragrance source received in the replenishment chamber Cr is supplied via the outside is chamber Co and the through-hole 410*b* through the second diverged pipe S25 and the main pipe S21 to the tub 21 or drum 31.

Meanwhile, if the user does not press the inner button 429 any more, the cartridge 420 is returned to its original position by the restoring force of the elastic member 427, and the emission hole 421*a* vanishes, thereby not supplying fragrance any more.

Meanwhile, if the inner button is pressed and then released, fragrance of the fragrance source in the replenishment chamber Cr is released, thereby emptying the replenishment chamber Cr. However, the fragrance source in the first chamber C1 is continuously supplied to the replenishment chamber Cr through the fragrance holes 423*a* in the horizontal wall 423.

Meanwhile, if the fragrance source in the first chamber C1 is all consumed and there is a need for the fragrance source in the first chamber C1 to be replenished, the user presses the external button 440 and then turns it. Here, the hook 441 of the external button 440 is separated from a stopping protrusion 411 of the cartridge dock 410, and the fragrance supplying means 400 is separated from the cartridge dock 410.

Next, if the thusly separated external button 440 of the fragrance supplying means 400 is unscrewed, the inner button 429 is also turned, and thus the inner button 429 is separated from the cartridge 420. Here, the first chamber C1 is opened, and the fragrance source can be replenished to the first chamber C1.

Then, after the fragrance source is replenished, if the external button 440 is screwed onto the outer end of the cartridge 420, the inner button 429 is also turned, thereby being coupled to the cartridge 420.

Thereafter, if the external button 440 is pressed while being inserted into the cartridge dock 410, the hook 441 of the external button 440 is stopped by the is stopping protrusion 411 of the cartridge dock 410.

Here, the cartridge seal 430 installed between the fragrance supplying means 400 and the cartridge dock 410 is compressed, thereby completing the sealing between the fragrance supplying means 400 and the cartridge dock 410.

As described above, when the fragrance source in the fragrance supplying means 400 is consumed and there is a need to replenish it, the fragrance source can be easily replenished to the first chamber C1 by using the above method.

Figure 11:
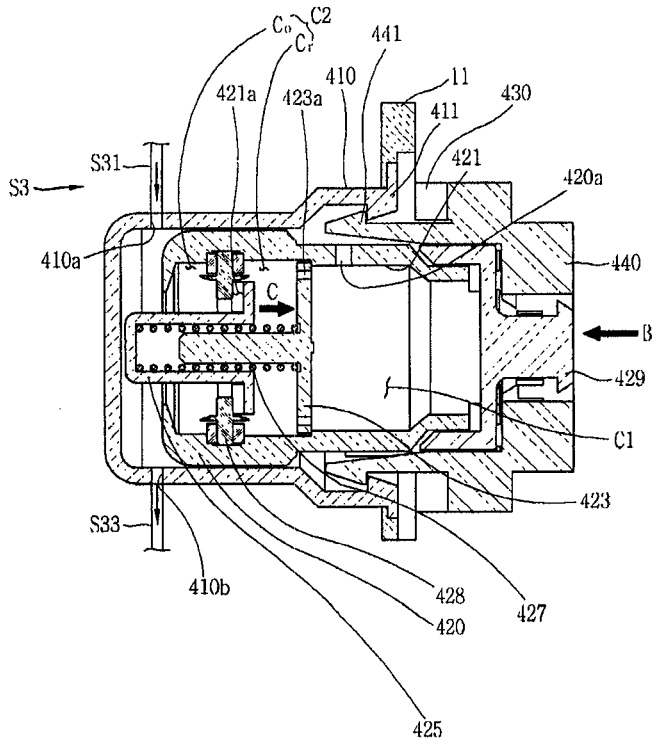
FIG. 11 is a diagram showing that a steam pipe of a steam supplying means is penetrated into a fragrance supplying means according to a sixth modification example of the present invention.

FIG. 11 is a diagram showing that a steam pipe of a steam supplying means is penetrated into a fragrance supplying means according to a sixth modification example of the present invention. For reference, the same reference numerals will be given to the same components having the same functions, and detailed explanations therefor are omitted. The arrows indicate the flow of steam flowing in first and second pipes.

Referring to FIG. 11, in order to supply all of the steam from the steam supplying means 30 to the fragrance supplying means 400, a steam pipe S3 of the steam supplying means 30 includes a first pipe S31 for supplying steam to a cartridge dock 410, and a second pipe S33 for supplying steam from the cartridge dock 410 to a tub 21 or drum 31.

In more detail, the first pipe S31 is connected to a through-hole 410*a* formed in the circumference of the cartridge dock 410. The second pipe S33 serves to connect another through-hole 410*b* formed in the circumference of the cartridge dock 410 and a spray nozzle 34 (referring to FIG. 1).

With the above construction, all steam is supplied into the cartridge dock 410 through the first pipe S31, is mixed with fragrance, and then is supplied to the spray nozzle 34 through the second pipe S33, thereby being sprayed into the tub 21 or drum 31. Since the steam is directly passed through the inside of the cartridge dock 410, the steam heat can be directly transferred to the fragrance source received in the cartridge 420. Accordingly, the evaporation of the fragrance source can be promoted. Also, fragrance mixed with steam can be prevented from being emitted to other places, thereby securing the supply of fragrance to the tub 21 or drum 31.

Figure 12:
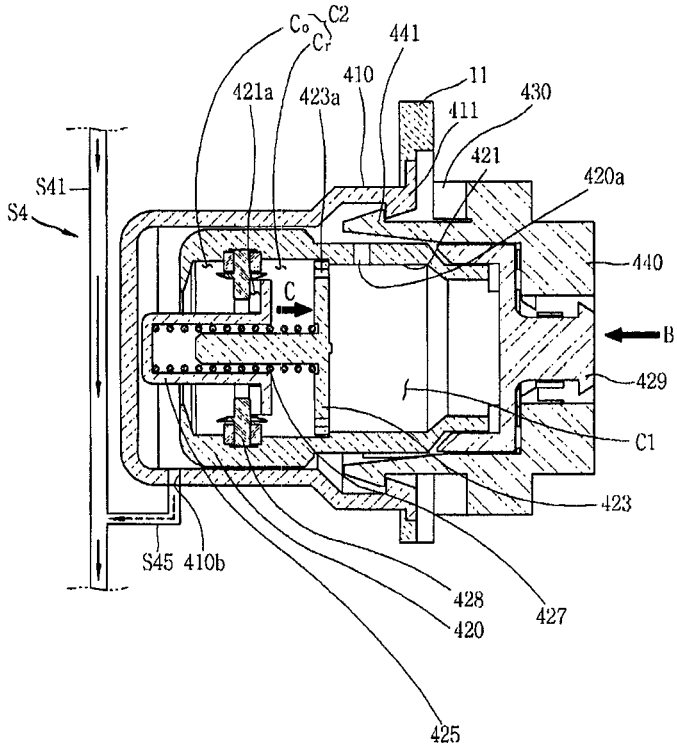
FIG. 12 is a diagram showing that a fragrance supplying means and a steam supplying means are connected to each other by a connection pipe according to a seventh modification example of the present invention.

FIG. 12 is a diagram showing that a fragrance supplying means and a steam supplying means are connected to each other by a connection pipe according to a seventh modification example of the present invention. For reference, the same reference numerals will be given to the same components having the same functions, and detailed explanations therefor are omitted. The solid line arrows indicate the flow of steam flowing in a main pipe S41. The dashed line arrows indicate fragrance discharged from a connection pipe S45.

Referring to FIG. 12, a steam pipe S4 of the steam supplying means 30 includes a main pipe S41 for supplying steam to the inside of the tub 21 or drum 31, and a connection pipe S45 for connecting the cartridge dock 410 and the main pipe S41. More specifically, the main pipe S41 is connected to the spray nozzle 34 (referring to FIG. 1) so as to supply steam into the tub 21 or drum 31. The connection pipe S45 connects the main pipe S21 and a through-hole 410*b* formed in the circumference of the cartridge dock 410.

With the above-mentioned construction, fragrance discharged from the fragrance supplying means 400 is mixed with steam flowing in the steam pipe S4 of the steam supplying means 30 and then is introduced into the tub 21 or drum 31. The steam heat is transferred into the cartridge dock 410 through the connection to pipe S45, thereby actively evaporating the fragrance source. Further, fragrance mixed with steam can be prevented from being emitted to other places, thereby securing the supply of fragrance to the tub 21 or drum 31.

What is claimed is:

1. A washing/drying machine, comprising:

a casing;

a tub received inside the casing for receiving washing water/hot air therein;

a drum rotatably disposed inside the tub for receiving laundry;

a fragrance supplying means for supplying fragrance to inside of the tub or the drum; and a heat supplying means for supplying heat to promote evaporation of a fragrance source stored in the fragrance supplying means, wherein the fragrance supplying means comprising:

a cartridge for storing the fragrance source and having a fragrance emission hole for emitting fragrance of the stored fragrance source;

a cartridge dock at which the cartridge is mounted; and an opening/closing means for selectively opening/closing the fragrance emission hole, wherein the opening/closing means is a plate spring for opening the fragrance emission hole when the cartridge is mounted at the cartridge dock, the plate spring comprising:

a curved portion having one end thereof fixed to the cartridge and another end thereof free;

an end portion disposed at an end of the curved portion and contacting a protrusion formed in the cartridge dock; and a stopper protruding from the curved portion and for opening the fragrance emission hole when the end portion contacts the protrusion.

2. The washing/drying machine of claim 1, further comprising a fragrance supplying pipe for supplying fragrance to the inside of the tub or the drum, and wherein the heat supplying means is a heater.

3. The washing/drying machine of claim 1, further comprising a fragrance supplying pipe for supplying fragrance to the inside of the tub or the drum, and wherein the heat supplying means is a steam pipe.

4. The washing/drying machine of claim 1, wherein the heat supplying means is a hot blast duct.

* * * * *